US007887467B2

(12) United States Patent
Booker

(10) Patent No.: US 7,887,467 B2
(45) Date of Patent: Feb. 15, 2011

(54) WHISTLING PUNCHING BAG

(76) Inventor: Bruce Wayne Booker, P.O. Box 263, Carbondale, IL (US) 62903-0263

( * ) Notice: Subject to any disclaimer, the term of this patent is extended or adjusted under 35 U.S.C. 154(b) by 1743 days.

(21) Appl. No.: 10/790,300

(22) Filed: Mar. 1, 2004

(65) Prior Publication Data

US 2005/0192165 A1 Sep. 1, 2005

(51) Int. Cl.
*A63B 21/00* (2006.01)

(52) U.S. Cl. ..... 482/83; 482/90; 482/87

(58) Field of Classification Search ..... 482/83–90, 482/93–100; 446/28, 184, 397, 396, 193, 446/197; 2/18, 48; 273/376; 473/445, 441
See application file for complete search history.

(56) References Cited

U.S. PATENT DOCUMENTS 2,098,925 A * 11/1937 Schaeffer ..... 446/184
2,559,889 A * 7/1951 Matthews ..... 401/61
2,912,791 A * 11/1959 Cohen ..... 446/186
4,084,811 A 4/1978 Kyo
4,108,428 A 8/1978 Winterbottom
4,208,048 A 6/1980 Winterbottom
4,210,322 A * 7/1980 Pritchard ..... 482/23
4,440,400 A * 4/1984 Neuberger ..... 473/426
4,676,511 A * 6/1987 Mackie ..... 273/376
5,209,691 A * 5/1993 Ekstein ..... 446/28
5,281,191 A * 1/1994 DeSousa ..... 482/83
5,427,796 A * 6/1995 Lewis ..... 424/426
5,741,970 A * 4/1998 Rubin ..... 73/379.05
6,422,912 B1 * 7/2002 Summers ..... 446/184
6,435,937 B1 8/2002 Naegele
6,544,099 B2 4/2003 Shafik

* cited by examiner

*Primary Examiner*—Jerome Donnelly
(74) *Attorney, Agent, or Firm*—Polster Lieder Woodruff & Lucchesi, LC

(57) ABSTRACT

An improvement to a striking bag for boxing or martial arts practice, which provides aural feedback to the user, as to the accuracy of strikes. Compressible pneumatic targets (10-A, 10-B, 10-C) are mounted partially into the side of a striking bag (9). Targets (10-A,10-B,10-C) are compressible both outside and inside the surface of the striking bag (9). When any of the pneumatic targets (10-A, 10-B, 10-C) are compressed by a strike, displaced air is driven into a pneumatic hose (34, 36, 38 respectively) which runs through the interior of the striking bag, connecting the pneumatic target to a whistle (12). Flexible washers on the inside (14) and outside (16) of striking bag (9) mount each pneumatic target (such as 10-A), onto striking bag (9). The inner washer (14), and outer washer (16), are connected through the surface of striking bag (9) by bolts (18,20,26, 28) and nuts (22,24,30,32). Alternate embodiments include pneumatic targets (10-D,10-E,10-F, 10-G,10-H).

7 Claims, 3 Drawing Sheets

WHISTLING PUNCHING BAG

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION

1. Field of Invention

This invention relates to punching bags, for martial arts or boxing practice, specifically, a method of enhancing accuracy of strikes by audible feedback.

2. Prior Art

One drawback to the standard striking or punching bag is that the user has no aural feedback as to the accuracy of strikes. While visual feedback as to accuracy of strikes may suffice in many situations, during a flurry of blows, it is sometimes difficult to judge the accuracy of strikes. In addition, aural feedback as to accuracy of strikes makes the use of a punching bag more stimulating to the user.

Some inventions have incorporated aural feedback into a striking target, such as U.S. Pat. No. 6,544,099 B2 to Shafik, (2003). The Shafik "Suspendable Talking Apparatus" is a self-contained portable device that may be suspended on a punching bag. However, the Shafik patent requires electronics, which means a higher cost of manufacture and use, than a device that does not require electronics and batteries. Also where electronics are involved, the device is likely to be more fragile, because electronic parts, even in a housing, may be vulnerable to impact. The Shafik patent did not contemplate integration into a punching bag involving multiple points or targets, which could produce aural feedback only upon the target being struck by the user.

U.S. Pat. No. 6,435,937 B1 to Naegele, (2002), was another attempt to integrate aural feedback into a target. However, the Naegele Patent was essentially a doll containing multiple sensors for application of steady pressure, or squeezing force, and did not contemplate the use of striking targets. The Naegele patent also required electronics to function.

U.S. Pat. No. 4,084,811 to Kyo, (1978), made a clever use of a simple pneumatic compressible device as a striking target. However, the Kyo patent was basically for the practice of power hitting, and did not contemplate multiple striking targets for accuracy training. The Kyo patent did provide for a pressure gauge operated pneumatically to determine the power of strikes, but did not provide for aural feedback to the user upon striking the target.

U.S. Pat. No 4,108,428 to Winterbottom, (1978) consisted of a large spherical compressible striking target with a pressure gauge, to practice power hitting. This patent contemplated that the target would be held by an assistant, or that one target could be incorporated into a full size punching bag. U.S. Pat. No. 4,208,048 to Winterbottom, (1980) added an additional embodiment in which a "pneumatic pressure container" would fit under the outer skin of a punching bag, and be connected to a pressure gauge. Neither of the Winterbottom patents would be helpful in practicing striking accuracy, as neither patent contemplated one or more small targets on a full size punching bag. Also, neither Winterbottom patent contemplated aural feedback, to the user, only visual feedback by means of a pressure gauge.

SUMMARY

This invention is a punching bag for boxing or martial arts practice. The punching bag uses compressible, pneumatic targets, to drive air through hoses and into a whistle. The invention allows immediate aural feedback to the user, as to the accuracy of strikes, without the need for electronics.

OBJECTS AND ADVANTAGES

A. A punching bag for martial arts or boxing practice, which provides aural feedback to the user regarding accuracy of strikes.

B. A punching bag which provides aural feedback to the user, as to accuracy of strikes without the need for electrical power.

C. A punching bag using pneumatic targets and whistles to provide aural feedback to the user regarding accuracy of strikes.

D. Pneumatic targets that are compressible both outside the surface of a punching bag, and inside the surface of a punching bag, while remaining in position, relative to the striking bag.

DRAWING FIGURES

LIST OF REFERENCE NUMERALS

Figure 3:
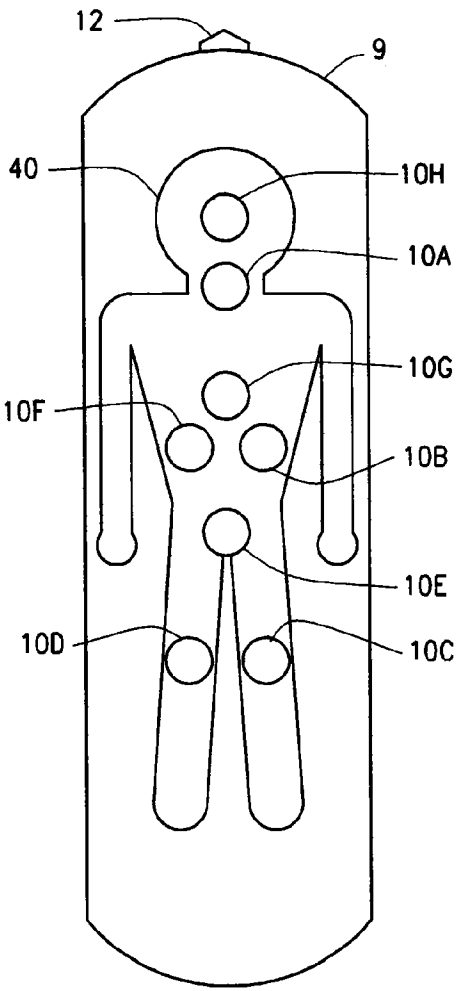
FIG. 3 is a front view of my invention, in an embodiment with numerous pneumatic targets.

9 outer wall of punching bag
10-A upper pneumatic target
10-B middle pneumatic target
10-C lower pneumatic target
10-D through 10-H, alternate pneumatic targets
12 whistle
14 inner washer
16 outer washer
18 top right bolt
20 bottom left bolt
22 top right nut
24 bottom left nut
26 top left bolt
28 bottom right bolt
30 top left nut

32 bottom right nut
34 upper pneumatic hose
36 middle pneumatic hose
38 lower pneumatic hose
40 hole in surface of punching bag

DESCRIPTION OF INVENTION, MAIN EMBODIMENT

Figure 2:
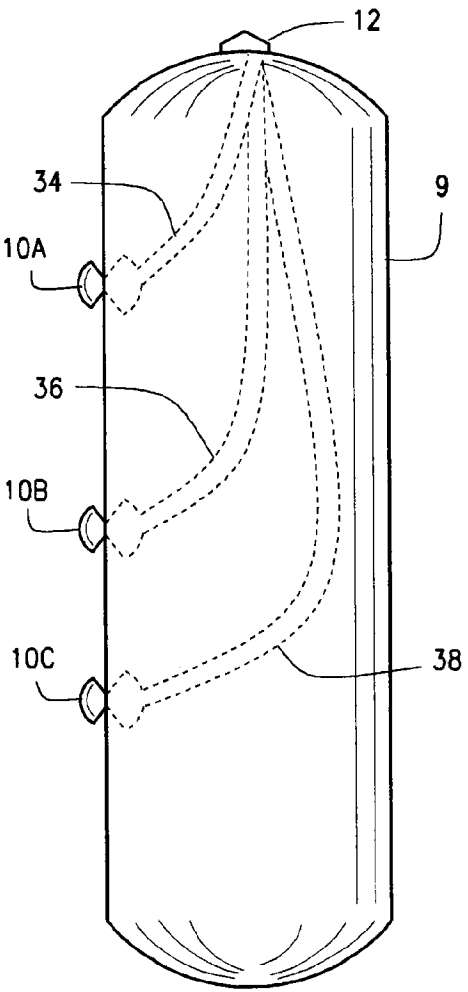
FIG. 2 is a side cut away view of my invention.
Figure 1:
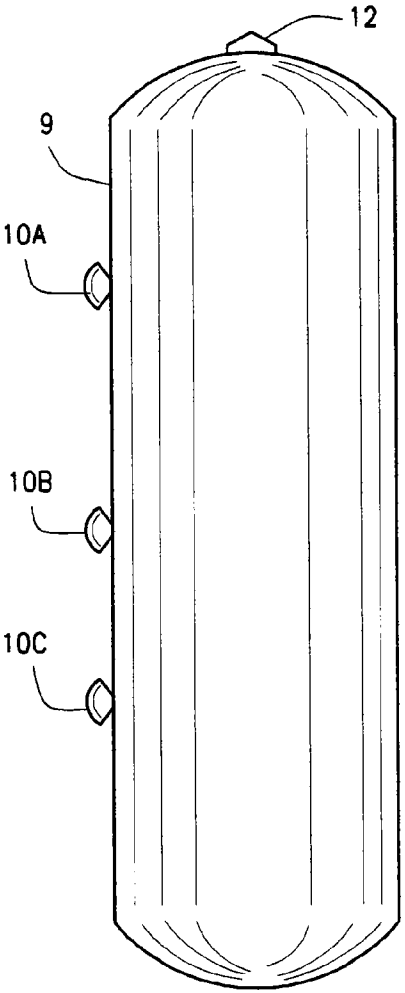
FIG. 1 is a side view of my invention.

A punching bag with pneumatic targets, capable of producing aural feedback as to the accuracy of strikes, as shown in FIGS. 1, 2. and 3. Reference numeral 9, in FIG. 1, refers to a conventional punching bag, with a normal surface material, such as leather, or plastic, or a sturdy cloth, and a normal filler, such as rag. The conventional punching bag filler is not shown. Reference numerals 10A, 10B, and 10C, from FIG. 1 are pneumatic targets. Reference numeral 12 from FIG. 1 is a whistle. Pneumatic hose 34, in FIG. 2, connects pneumatic target 10-A, to whistle 12. Likewise, in FIG. 2, pneumatic hoses 36 and 38 connect pneumatic targets 10-B and 10-C, respectively, to whistle 12. The pneumatic hoses 34, 36,and 38, run through the conventional punching bag filler (not shown).

Figure 4:
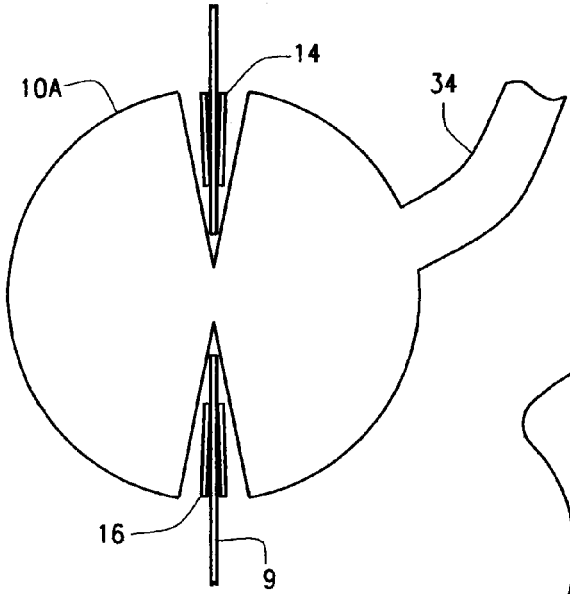
FIG. 4 is a close-up, cross-sectional view of the surface of the punching bag, and one of the pneumatic targets.
Figure 6:
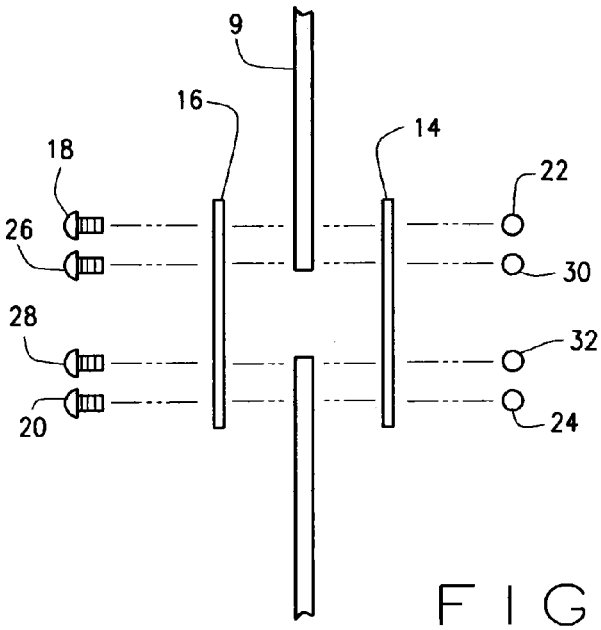
FIG. 6 is a cross-sectional view of the surface of the bag, and an exploded view of the parts that hold one pneumatic target in position.
Figure 7:
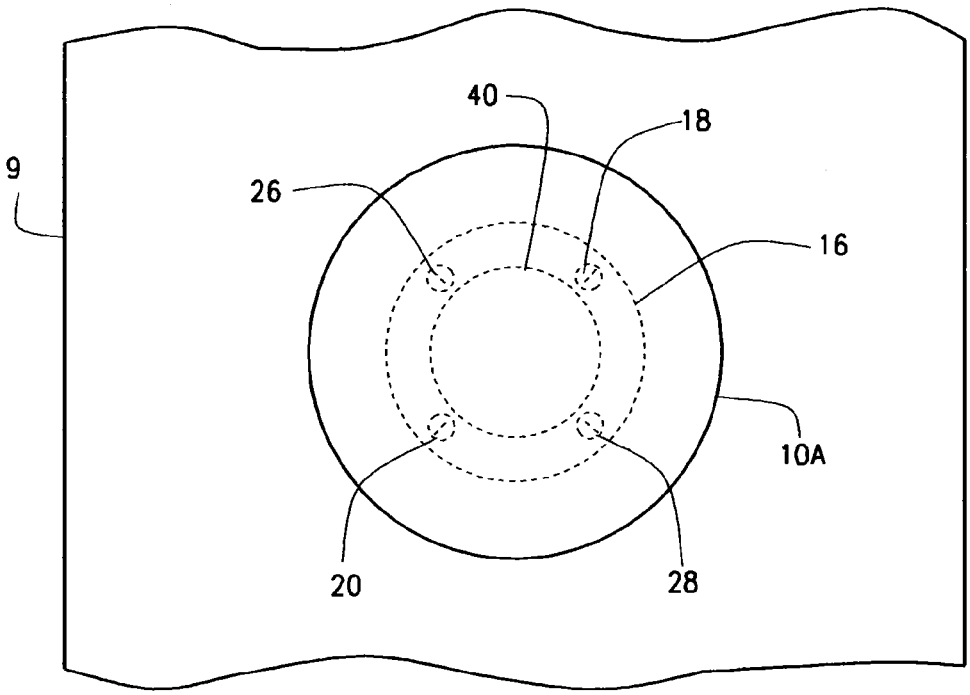
FIG. 7 is a close up front view of one pneumatic target mounted on a bag, with hidden lines to show the parts behind the pneumatic target.

At FIG. 4, we see pneumatic target 10-A, held in place on bag 9, by outer washer 16, and inner washer 14. At FIG. 6, which has the pneumatic target removed for the sake of clarity, we see the hardware that holds pneumatic target 10-A in place. This hardware is outer washer 16 and inner washer 14, held in place on bag 9 by top right bolt 18, top left bolt 26, bottom right bolt 28, and bottom left bolt 20, along with top right nut 22, top left nut 30, bottom right nut 32, and bottom left nut 24. FIG. 7 indicates (by hidden lines) pneumatic target 10-A held in place, with outer washer 16 and bolts 26, 18, 20 and 28 in place behind pneumatic target 10-A. In FIG. 7, 40 represents a hole in the surface the bag 9, through which the inner half of the pneumatic target, 10-A, is inserted into the bag 9. Exactly the same type of mounting hardware (inner washer 14, outer washer 16, top right bolt 18, bottom left bolt 20, top right nut 22, bottom left nut 24, top left bolt 26, bottom right bolt 28, top left nut 30, bottom right nut 32), as used for target 10-A, is used to mount targets 10-B, and 10-C to the surface of bag 9. Since the same type of mounting hardware is used for targets 10-A, 10-B, and 10-C, only the mounting hardware for one target (10-A), is shown. Half of each pneumatic target 10-A, 10-B, and 10-C, is inside the surface of the bag 9, and half of each target is outside the surface of the bag, as shown in FIG. 2.

Operation of Invention, Main Embodiment

Figure 5:
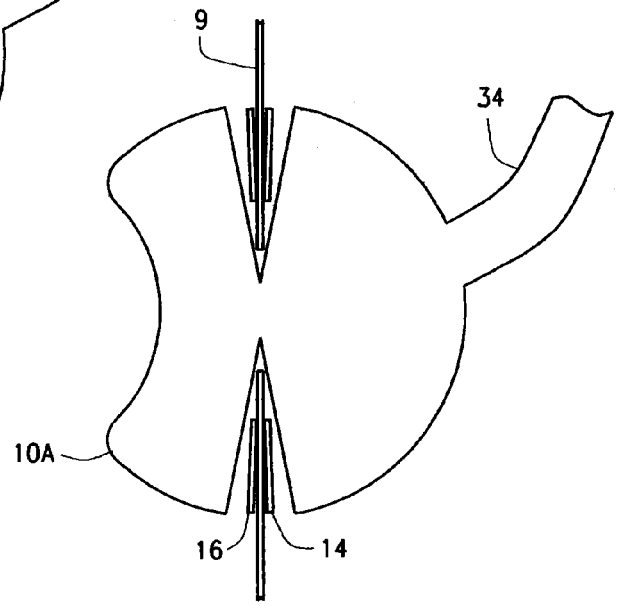
FIG. 5 is a close-up, cross-sectional view of the surface of the punching bag and one of the pneumatic targets, in a partially compressed condition.

The method of use of this invention is as follows: The user strikes, with hand or foot, or other extremity, one or more of the pneumatic targets, represented in FIG. 1 as 10-A, 10-B, and 10-C. Pneumatic target 10-A is shown close up and in a cutaway view in FIG. 4. In FIG. 5, 10-A is the pneumatic target as it is becoming compressed. In both FIG. 4 and FIG. 5, 16 is the outer washer, 14 is the inner washer, and 9 is the wall of the bag. Washers 16 and 14 and the bag wall 9, remain in relatively the same position when struck, although bag wall will flex to some degree. Washers 16 and 14 are constructed of flexible plastic, in order to be able to deform to some degree when one of the pneumatic targets, such as, 10-A is struck, and then return to a relatively flat condition.

Figure 8:
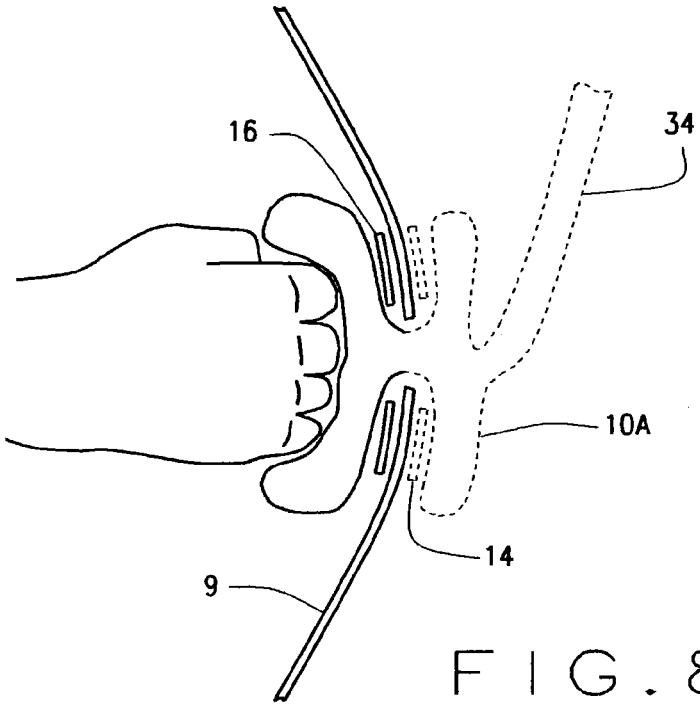
FIG. 8 is a cross sectional view of a pneumatic target, compressed both inside and outside the surface of the bag by the fist of a user, with hidden lines to denote the portion of the target inside the bag, and the attached pneumatic hose.

When a pneumatic target, such as 10-A, is compressed, a pneumatic hose conducts the air displaced by compression of the pneumatic target to the whistle 12, which then sounds. In FIG. 8, the pneumatic target 10-A, when struck by the user, is compressed both outside and inside the surface of bag 9. As shown in FIG. 2, each pneumatic target, 10-A, 10-B, and 10-C, is attached to a pneumatic hose, (34, 36, and 38 respectively), which run to whistle 12. FIG. 6 shows the assembly to hold pneumatic target 10-A in place, but for clarity's sake, the pneumatic target is absent from FIG. 6. Outer washer 16, and inner washer 14, (see FIG. 6) are somewhat flexible, but much stiffer than the surface of the bag 9.

By providing a stiffer surface surrounding a hole, 40, in bag 9 (see FIG. 7), the washers help to keep the pneumatic targets, such as 10-A in place, by preventing the target from being knocked through the hole, 40, in bag, 9. Outer washer 16, and inner washer 14, may have a cut, to facilitate mounting the washers around the narrow central portion of the pneumatic target, during assembly. Alternatively, outer washer 16, and inner washer 14, may have a central hole just large enough to slide over the larger portion of the pneumatic target, such as 10-A, if the larger portion of the pneumatic target is manually squeezed during assembly. When a pneumatic target is struck, outer washer 16, and inner washer 14, flex and return to original shape, while bolts 18, 26, 28, and 20, and nuts 22, 30, 32, and 24, remain in the same position, relative to outer washer 16 and inner washer 14, as shown in FIG. 8.

Alternative Embodiments

FIG. 3 illustrates one of many possible arrangements of the pneumatic targets (10A through 10H) on the surface of the bag 9. The operation of the invention is the same as in the preferred embodiments, except that there are more targets. (and more pneumatic hoses, which are not shown), leading to the whistle, 12. Exactly the same type of mounting hardware is used for every pneumatic target, as was used to mount pneumatic target 10-A (inner washer 14, outer washer 16, top right bolt 18, bottom left bolt 20, top right nut 22, bottom left nut 24, top left bolt 26, bottom right bolt 28, top left nut 30, bottom right nut 32).

CONCLUSIONS, RAMIFICATIONS, AND SCOPE

Thus the reader will see that the invention provides a highly reliable, economical, and versatile punching bag with audible feedback for the user. While my above description includes many specifications, these should not be construed as limitations on the scope of the invention, but rather as an exemplification of one preferred embodiment thereof Many other variations are possible, for example:

- Rivets may be used in place of bolts and nuts, to hold the inner and outer washers in place.
- The pneumatic targets could be of varying size on the punching bag, with larger targets for kicking, medium-size targets for punching, and smaller targets for finger strikes.
- The whistle could be placed in different locations, such as the bottom of the bag, or even on the side of the pneumatic targets themselves, thus eliminating the need for pneumatic hoses.
- More than one whistle could be used, with a separate whistle connected to each pneumatic target, or group of pneumatic targets, with each whistle sounding at a different pitch.
- The punching bag itself could be suspended from above, by a rope or chain, or be supported by a post that inserts into the bottom of the bag. Any number of bag configurations can easily be adapted by placement of whistles and pneumatic targets.

Placement of pneumatic targets can be adapted for different types of use, such as boxing or martial arts practice.

The whistles could be removable, or have a switch on each whistle, to allow for relatively quiet use of the bag, when the user wishes to do so.

The pneumatic targets could be adapted for use on a human shaped dummy.

Accordingly, the scope of the invention should be determined not by the embodiments illustrated, but by the appended claims and their legal equivalents.

The invention claimed is:

1. A whistling punching bag comprising:

(a) a punching bag having a cover having an inside and an outside and filler material within the cover;

(b) a plurality of compressible pneumatic targets extending through an opening in said cover of said punching bag such that a first half of each compressible pneumatic target is exposed on the outside of the punching bag cover and a second half of the compressible pneumatic target is on the inside of the punching bag cover, the exposed first half of a pneumatic target being positioned to receive a strike from a user whereby the first and second halves of the compressible pneumatic target are compressed;

(c) a whistle on said punching bag apart from said plurality of compressible pneumatic targets; and (d) air conduits extending from said compressible pneumatic targets to the whistle for conducting air from the compressible pneumatic target to the whistle when one or more of said plurality of compressible pneumatic targets is struck by a user.

2. A whistling punching bag comprising:

(a) a punching bag having a cover and a filler material within the cover, (b) at least one compressible pneumatic target fixed in an opening in said punching bag cover such that a portion of the at least one compressible pneumatic target is exposed on the cover of the punching bag and another portion of the at least one compressible target is within the cover;

(c) means for fixing said at least one compressible pneumatic target in the opening in the punching bag cover;

(d) a whistle positioned on the punching bag apart from said at least one compressible pneumatic target, and (e) a pneumatic hose extending through the filler material and connecting said at least one compressible pneumatic target to said whistle.

3. The whistling punching bag of claim 1 wherein said plurality of compressible pneumatic targets are arranged on the punching bag in a pattern corresponding to areas of the human anatomy.

4. The whistling punching bag of claim 1 wherein each of said plurality of compressible pneumatic targets further comprises a constricted area between the first half and the second half.

5. The whistling punching bag of claim 4 further comprising first washer positioned around the constricted area between the first and second halves of the compressible pneumatic target outside of the punching bag cover, and a second washer positioned around the constricted area between the first and second halves of the compressible pneumatic target within the punching bag cover.

6. The whistling punching bag of claim 5 wherein the first and second washers are flexible.

7. A whistling punching bag comprising:

a punching bag having a cover and filler material inside the cover;

a plurality of compressible pneumatic targets, each said target having a first half and a second half with a constricted area between the first and second halves, each said target extending through an opening in said cover of said punching bag such that the first half of each compressible pneumatic target is exposed outside of the punching bag cover and the second half of the compressible pneumatic target is within the punching bag cover, the exposed first half of each pneumatic target being positioned to receive a strike from a user whereby the first and second halves of the compressible pneumatic target are compressed;

an outer washer positioned around the constricted area between the first and second halves of the compressible pneumatic target outside of the punching bag cover, and an inner washer positioned around the constricted area between the first and second halves of the compressible pneumatic target within the punching bag cover;

attachment apparatus for attaching said outer washer to said inner washer;

a whistle on said punching bag positioned apart from said plurality of compressible pneumatic targets; and air conduits extending from said compressible pneumatic targets through the filler to the whistle for conducting air from the compressible pneumatic target to the whistle when one or more of said plurality of compressible pneumatic targets is struck by a user.

* * * * *